United States Patent [19]

Basil, Jr. et al.

[11] 4,057,772

[45] Nov. 8, 1977

[54] THERMALLY COMPENSATED MICROWAVE RESONATOR

[75] Inventors: Richard V. Basil, Jr., Canoga Park; Leons Ondrups, Pacific Palisades; James K. Shimizu, Palos Verdes Estates, all of Calif.

[73] Assignee: Hughes Aircraft Company, Culver City, Calif.

[21] Appl. No.: 733,833

[22] Filed: Oct. 18, 1976

[51] Int. Cl.[2] ..... H01P 1/30; H01P 7/06

[52] U.S. Cl. ..... 333/83 T; 333/82 BT

[58] Field of Search ..... 333/83 T, 82 BT

[56] References Cited

U.S. PATENT DOCUMENTS

| | | | |
|---|---|---|---|
| 3,034,078 | 5/1962 | McCoubrey | 333/83 T |
| 3,063,030 | 11/1962 | Manahan et al. | 333/83 T |

*Primary Examiner*—Paul L. Gensler

*Attorney, Agent, or Firm*—John Holtrichter, Jr.; W. H. MacAllister

[57] ABSTRACT

Thermal compensation for frequency control of microwave resonators through utilization of bimetallic boundary motion type phenomena is described, the resonator being rectangular and preferably having composite broad walls of integral layers, one of which having a relatively lower thermal expansion coefficient than another of the layers and each having an initial deformation in a stabilized curvature condition to render these walls frequency sensitive.

23 Claims, 9 Drawing Figures mal coefficient, but also a zero frequency coefficient with proper selection of material combinations. The thermal expansion coefficients of such materials need only be different, and are not limited to low values or to metals.

FIG. 2 illustrates a basic bimetallic-type cavity system 21 where the external surface material expands more than the base material. For this example, the external surface 23 of the cavity 21 may be silver, while the base structure 25 may be any metal or nonmetal having a lower thermal coefficient of expansion. It can be seen from the dashed outline 27 that at high temperatures the silver has expanded more than the base material pulling the broadwalls 29 (and a tuning screw 31 in one of these walls) out of the cavity more than the characteristic dimensions of the cavity expand (see FIG. 1), which causes a net increase in resonant frequency. Alternately, dashed outline 33 illustrates the low temperature condition where the silver contracts more than the base material, pushing the broadwall and tuning screw into the cavity more than the characteristic dimensions contract, for a net decrease in resonant frequency. The solid outline indicates the cavity configuration at room temperature and nominal resonant frequency.

Referring now to FIG. 3, there is shown an Invar-silver cavity structure 41 having broad walls 43 and narrow walls 45. In this embodiment, an Invar wall structure 47 is plated on its interior surface with a relatively thin layer 49 of silver, and on its outer surface with a relatively thick layer 51, also of silver. Invar as a material has traditionally been selected for the fabrication of microwave filters because its thermal expansion coefficient is the lowest available in the metal group. Basically, the expansion coefficient of Invar is 1.0 PPM/° F. However, the lower electrical conductivity of the material necessitates the application of high electrical conductivity materials such as silver and/or copper with sufficient thickness in terms of frequency skin depths to achieve the required electrical performance. As the ratio of plating thickness to Invar material thickness increases, the overall thermal expansion coefficient of the system increases as a consequence of the material combinations. Copper is used as a base plating on Invar due to its superior adhesive qualities and silver is used for its superior electrical conductivity. The combination of silver and copper has an effective thermal expansion coefficient of approximately 10.0 PPM/° F. Therefore, for the case of equal plating thickness on both sides of an Invar cavity wall, the resultant expansion coefficient of the cavity is greater than Invar alone. Only when the ratio of plating thickness to Invar wall thickness is in the order of 5% does this effect become appreciable in terms of electrical performance.

In accordance with this aspect of the present invention, a cavity having different plating thicknesses on its inner and outer walls provides a thermal bimetallic-type system which can distort the wall in either direction. It has thus been found that in an Invar cavity having more plating on the exterior walls than on the interior walls, the frequency shift of the cavity can be controlled in the proper direction for an effective zero thermal frequency coefficient. As seen in FIG. 3, the broadwall surfaces 43 of the cavity 41, one of which being provided with a tuning screw 53, are constructed with an initial deformation (preferably inward) in a stabilized condition to render them frequency sensitive. Because the inward deformation of the broadwalls is of the order of only a mil or two, these walls are shown as planar in FIG. 3.

As temperature increases, the characteristic dimensions of the cavity 41 increase which results in a decrease of cavity frequency. However, when the thicker external silver plating expands with temperature, it deflects the broadwalls, including the one which carries the tuning screw 53, into the cavity volume so as to increase the resonant frequency of the cavity. In a construction of the type of cavity illustrated in FIG. 3, it has been clearly demonstrated that the decrease in cavity frequency due to wall distortion is significantly greater than the decrease in cavity resonant frequency due to the increase in characteristic dimensions. Consequently, thermal compensation of the cavity has been achieved. The converse is true with decreasing temperature.

If the broadwalls and narrow walls of a rectangular cavity distort in opposite directions, the bimetallic type boundary movement of the broadwall is enhanced by providing the narrow wall with less external plating thickness or at least equal thickness. This configuration is generally outlined in FIG. 4. Here, the broadwalls 61 are provided with an initial curvature into the cavity volume not only to render them frequency sensitive, but to ensure that the bimetallic critical temperature is outside the functional temperature range of the cavity. This critical temperature occurs when the bimetallic type system snaps from one curvature to a different curvature for equilibrium, as shown in the outline of FIG. 5, for example.

A bimetallic type strip, after heating, will tend to assume such a shape that the material with largest coefficient of thermal expansion is on the convex side or moves in the direction of the surface on which the more thermally expansive material is located. Upon cooling it will proceed in reverse and assume its original shape or go beyond that, depending on the temperature.

In the case of a strip with the initial curvature and the more expansive material on the concave side, this tendency of behavior is the same as for a straight free strip, however the change from concave to convex may not take place. This depends on the combination of the material's thickness, coefficients of expansion and the temperature range. The desired effects can be achieved by design in choosing the correct system parameters, well known to those skilled in the art.

If a rectangular structure such as a bandpass filter cavity is built of bimetallic construction, it, by necessity, will have rigid corner connections and therefore become internally statically indeterminate. Even if the original tendency of the walls upon heating is to bend so as to have the more expansive material on the convex side, this may not happen due to the rotation of the corner joints. The rotation may introduce a deflection opposite to the thermal deflection and cancel it out. The analogy of this phenomena is that of a pressurized rectangular cross-section where the short walls may cave in under the pressure when the long walls cave out. Rotation of the corners is proportional to the ratio of the lengths of the sides and to their stiffnesses. Only a completely square cavity cross-section will have no rotation of the corners and all walls will deflect in the same direction under pressure.

The behavior of a rectangular cross-section presents many opportunities to achieve desired properties and frequencies of a filter. This could be a combination of wall stiffness and length ratios, pre-shaping of the walls, variation of plating thicknesses and selective plating locus.

THERMALLY COMPENSATED MICROWAVE RESONATOR

BACKGROUND OF THE INVENTION

The background of the invention will be set forth in two parts.

1. Field of the Invention

The invention relates to microwave resonators and more particularly to thermal compensation for frequency control of microwave resonators.

2. Description of the Prior Art

Generally speaking, regardless of the material used, the frequency of a tuned cavity or resonator will change as a function of temperature. As the temperature rises, the material expands, the cavity volume and characteristic length increase and consequently the frequency of the cavity decreases. Of course, the converse is true for decreasing temperature.

The conventional technique to temperature compensate microwave cavities has been to utilize differential temperature coefficients between the tuning screw and its carrier. This provides a very limited amount of temperature compensation and, as will be shown subsequently, the total movement available by using the prior art coaxial technique is orders of magnitude less than the temperature compensating movement of a frequency governing structure of the present invention.

SUMMARY OF THE INVENTION

In view of the foregoing factors and conditions characteristic of the prior art, it is a primary object of the present invention to provide an improved thermally compensated microwave resonator.

Another object of the present invention is to provide a thermally compensated microwave resonator through a bimetallic boundary motion type technique.

Still another object of the present invention is to provide a simple yet effective and economical thermally compensated microwave resonator that incorporates a temperature-sensitive, frequency-determining wall structure exhibiting movement orders of magnitude greater than the total movement available by using the prior art coaxial technique.

In accordance with an embodiment of the present invention, a thermally compensated frequency controlled microwave resonator is provided for operation over a predetermined operational temperature range. The thermally compensated microwave resonator includes a rectangular resonator having conductive inner wall surfaces and oppositely disposed broad and narrow walls, at least one of the broad walls being a composite wall of integral wall layers, one of which having a relatively lower thermal expansion coefficient than another of the layers so that the wall deforms with changes in temperature in a predetermined manner. The composite wall has a critical temperature whereat the wall snaps from one stabilized curvature condition to a different stabilized curvature condition. The composite wall is provided with an initial deformation in one of the aforementioned stabilized curvature conditions so as to render the composite wall frequency sensitive and to provide that the critical temperature of the wall is outside its operational temperature range.

Preferably, both broad walls of the rectangular resonator exhibit the thermally-sensitive bimetallic type effect, and both such walls have an initial inward curvature for greatest sensitivity and range.

The features of the present invention which are believed to be novel are set forth with particularity in the appended claims. The present invention, both as to its organization and manner of operation, together with further objects and advantages thereof, may best be understood by making reference to the following description taken in conjunction with the accompanying drawing in which like reference characters refer to like elements in the several views.

DESCRIPTION OF THE PREFERRED EMBODIMENTS

Figure 1:
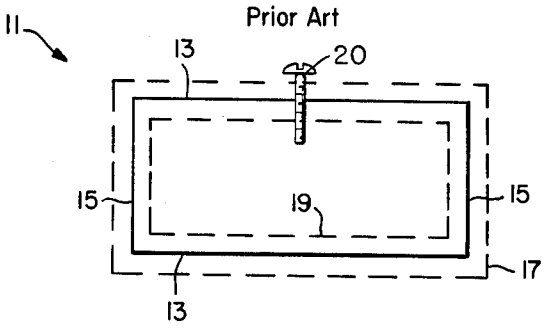
FIG. 1 is a schematically represented cross section of a standard rectangular prior art cavity or resonator indicating the type of resonant frequency changes which occur with changes in temperature.
Figure 2:
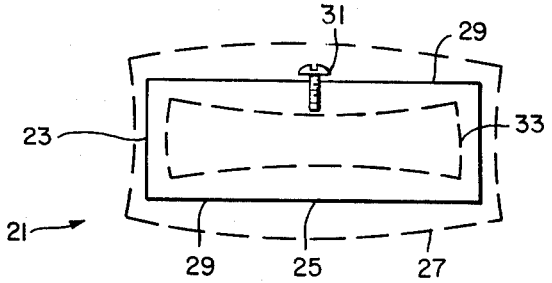
FIG. 2 illustrates a bimetallic cavity system indicating resonant frequency changes corresponding to changes in temperature, in accordance with the principles of the present invention.
Figure 3:
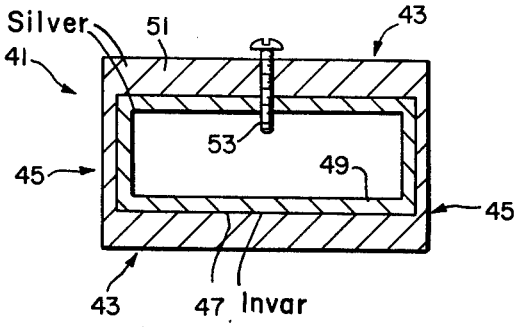
FIG. 3 illustrates an Invar-silver configuration for a temperature compensated microwave resonator in accordance with the present invention.
Figure 4:
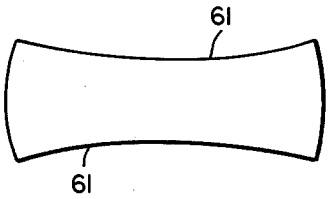
FIGS. 4 and 5 are outline representations illustrating wall response to cavity distortion respectively as to its response to cooling, and its response to heating.
Figure 5:
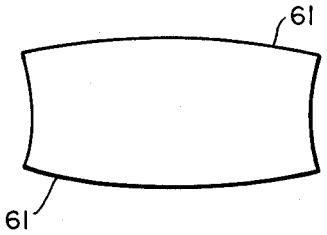

Referring now to the drawings and more particularly to FIG. 1, there is shown a cross section of a standard cavity 11 exemplary of the prior art and having oppositely disposed broad walls 13 and narrow walls 15, the distortions being purposely exaggerated for clarity. This illustration shows increased-volume dashed outline 17 providing a decrease in resonant frequency due to relatively high temperature over the room temperature structure having nominal frequency. In the other direction, the inner dashed outline 19 shows the decreased-volume configuration caused by a lower-than-room temperature and leading to an increased resonant frequency for the structure 11.

Figure 6:
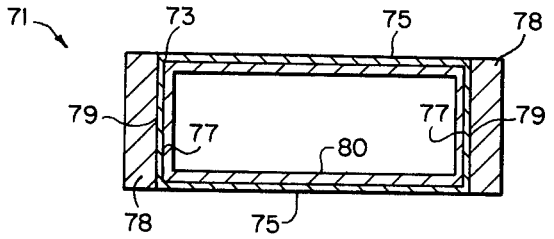
FIG. 6 is a cross sectional representation of a thermally compensated aluminum filter cavity utilizing bimetallic boundary control in accordance with another embodiment of the present invention.

In addition to the frequency change experienced by tuned cavities due to changes of characteristic dimensions as a function of temperature, several other techniques exist for changing the frequency of tuned cavities. If a tuning screw 20 is introduced into the cavity volume through the middle of a broadwall surface, the added capacitance decreases the frequency of the cavity. As a tuning screw is introduced into the cavity volume through the middle of a narrow wall surface, the added inductance increases the frequency of the cavity. These same phenomena occur when the walls are distorted into the cavity. Consequently, control of cavity wall distortions provides an effective vehicle for changing the frequency of the cavity in a desirable direction. A properly devised configuration can provide a cavity with not only a controlled frequency ther- As an example of the case where thermal frequency control for a zero or low frequency thermal coefficient is possible using materials with high thermal expansion coefficients, an aluminum filter 71 provided with silver plating is illustrated in FIG. 6. Aluminum has a thermal expansion coefficient of approximately 14.0 PPM/° F while silver has a thermal expansion coefficient of approximately 10.0 PPM/° F. The plating sequence would require a nickel base plate on aluminum for proper adhesion and the copper-silver plating over the nickel. Since nickel has a thermal expansion coefficient of approximately 7.0 PPM/° F, this enhances the behavior of the copper-silver plating.

Employing the same logic as previously developed, the aluminum cavity 71 comprises an aluminum base structure 73 with bare uplated broadwalls 75 and narrow walls 77, the latter having silver plated layers 78 on their respective external surfaces 79. The interior surfaces 80 of the cavity 71 are provided with a plating of a material having a smaller thermal expansion coefficient than aluminum for proper mechanical operation. In this embodiment, silver is preferred because it provides optimum electrical performance. Although the external silver plating of the narrow walls 77 is shown thicker than the thickness of the internal wall surfaces, these thicknesses may be the same. The system of FIG. 6 results in thermal compensation in the correct directions. Consequently, it is practical to design an aluminum filter with thermal frequency characteristics comparable to the more expensive Invar and graphite filters. From a weight and cost point of view, the bimetallic wall technique represents a revolutionary advance in the design of microwave filters for spacecraft applications.

The following is a summary of calculations to predict the movement of bimetallic wall systems. As will be shown, the only limitation to wall movements will be the yield strength of the materials used due to stresses imposed at the bimetallic boundaries.

The principle underlying the bending of a bimetallic type thermostat is the unequal thermal expansivity (unequal thermal expansion coefficient) of the two materials. The materials must stay bonded together while being cooled or heated. During these thermal processes the shear forces are generated along the bonded surface (interface) of the two materials. These shear forces are not uniformly distributed over the cross-section and therefore cause bending (buckling) of the bimetallic strip, or plate.

A strip or a long plate will form a cylindrical surface after bending. A short or rectangular plate will generate a spherical surface provided the deflection is small as compared to the total thickness. This implies that the surface after bending must be a developable surface, i.e. either cylindrical or spherical which have a constant radius of curvature over the length of the element in order to satisfy the relation $1/\rho = (M/EI.)$ This relation is valid only within the elastic range of the material and assumes that the strains at the middle surface of the plate are negligible and the cross-sections remain plane after bending.

Figure 7:
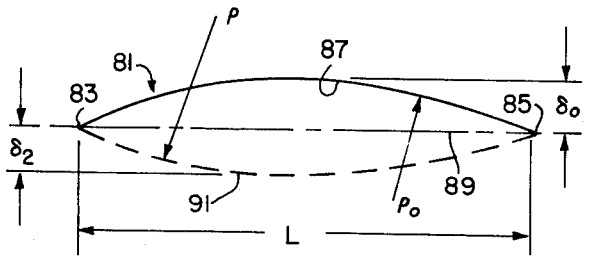
FIG. 7 is a line diagram illustrating a bimetallic type thermostat strip or plate constructed with and without an initial radius of curvature.

A bimetallic type thermostat strip or plate can be built with or without initial radius of curvature $\rho_o$. Consider a strip 81 with initial curvature $1/\rho_o$ between ends 83 and 85 and an initial deflection $\delta_o$ bent in such a way that the material with the largest coefficient of expansion is on the concave side 87 as shown in FIG. 7. During the heating of the strip 81 the original curvature will gradually diminish and, at a certain temperature, the strip will pass through the plane form 89 and become curved downward as shown by the dashed line 91. This gradual change of curvature occurs only if the strip is free at the ends 83 and 85. However if the strip 81 is fastened or supported at the ends (points 83 and 85), the initial decrease of original deflection $\delta_o$ will be gradual to some value $\delta_1$ then a buckling (snapping) downwards will take place. The reverse process of this phenomena will occur upon cooling of a buckled strip.

The maximum stress during heating of bimetal strip will be produced in the fibers of the bearing surface of the two metals. This stress consists of two parts: (*a*) the stress due to axial force, and (*b*) stress due to bending. These stresses also produce a shearing stress along the bonding surface. Little is known in the literature about exact distribution of these shearing stresses along the bonding surface. However it is shown in an article entitled "Analysis of Bi-metal Thermostats," by S. Timoshenko, in the Journal of the Optical Society of America, 2, 3 (September 1925), pp. 233–255, that the shearing stresses are of a "local" type and are concentrated at the ends of the strip for a distance equivalent to the total thickness of the two metals, and their magnitude is of the same order as the normal stresses. Due to this maximum, normal stresses can be used to design the bond between the two metals.

Maximum stress at bonding surface is calculated from:

$$P_{max} = \frac{1}{\rho}\left[\frac{2}{hh_1}(E_1I_1 + E_2I_2) + \frac{h_1E_1}{2}\right].$$

Figure 8:
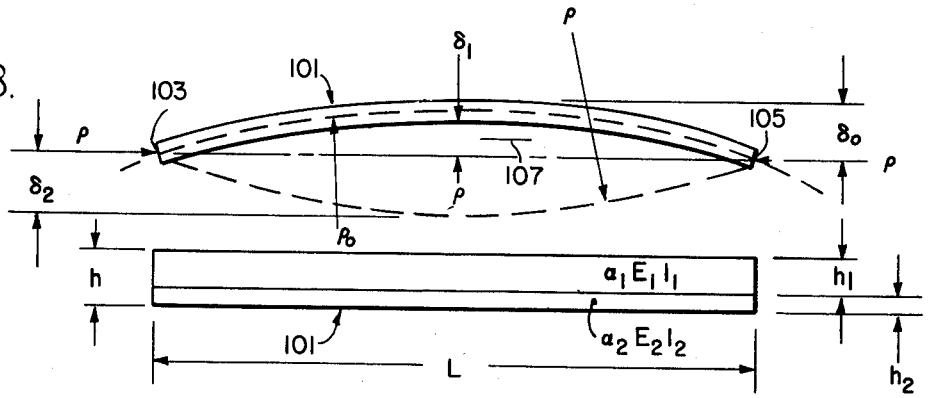
FIG. 8 is a line diagram useful in calculating the thermostat properties of a bimetallic type strip or plate.

In calculating the thermostat properties, reference is now made to FIG. 8, where

- L = length of the strip 101, the width is taken as equal to unity
- $\rho_o$ = the initial radius of curvature
- $\delta_o$ = the initial deflection of the strip 101 between ends 103 and 105
- $A = 1 \times h$ = the area of the cross-section of the strip 101
- $I = I \times h^3/12$ = the moment of interia of the cross-section
- $E = \frac{1}{2}(E_1 + E_2)$ = the average modulus of elasticity
- $\delta$ = the deflection in a downward direction of the strip after heating for the case of "free ends"
- $\delta_1$ = the deflection measured in upward direction at which a sudden buckling of the strip begins
- $\delta_2$ = the deflection of the strip 101 in downward direction after buckling
- $t_o$ = the initial temperature of the strip
- $\Delta_t = t - t_o$ = the range of the temperature
- $h$ = the total thickness of metal of the strip 101
- $\alpha_1 \& \alpha_2$ = the coefficients of thermal expansion.

Assume a bimetal strip with initial deflection $\delta_o$ chosen so that $$\frac{3\,\delta_o^2}{h^2} = a \qquad (1)$$

where $a > 1$. Also assume that the material with the largest coefficient of expansion $\alpha$ is on the concave side.

This strip will deflect gradually down until it reaches deflection $\delta_1$, then it will buckle suddenly to position $\delta_2$ as shown in FIG. 8.

The $\delta_1$ is given as:

$$\delta_1 = \frac{\delta_o}{\sqrt{\frac{3a}{a-1}}} \quad \text{OR} \quad \frac{\delta_o}{\delta_1} = \sqrt{\frac{3a}{a-1}} \tag{2}$$

This enables us to calculate:

$$\frac{PL^2}{EI\pi^2} = \left[\frac{3L^2}{h\delta_0}(\alpha_2 - \alpha_1)(t - t_o) - 1\right]\frac{\delta_o}{\delta_1} + 1 \tag{3}$$

and $$\frac{PL^2}{EI\pi^2} = \left(\frac{3\delta_o^2}{h^2}1 - \frac{\delta_1^2}{\delta_o^2}\right) \tag{4}$$

The force P shall be calculated from both equations (3) and (4). If the force P as calculated from equation (3) is always larger than that from equation (4) the sudden buckling will occur. If for a certain ratio of $\delta_o/\delta_1$ the force of equation (3) is less than that of equation (4) the sudden buckling will be prevented.

Then the final buckling in reverse direction is $$\delta_2 = \frac{\delta}{1 - \frac{PL^2}{EI\pi^2}} \tag{5}$$

where $\delta$ is calculated from:

$$\delta = \frac{3L^2}{16h}(\alpha_2 - \alpha_1)(t - t_o) - \delta_o \tag{6}$$

The initial radius of curvature is known due to the predetermined initial deflection $\delta_o$.

$$\text{From: } \delta_o = \frac{L^2}{8\rho_o} \quad \rho_o = \frac{L^2}{8\delta_o}$$

The final radius of curvature is calculated in the same manner after the final deflection $\delta_2$ is determined.

For a strip with no initial deflection the curvature is calculated from expression:

$$\frac{1}{\rho_o} = \frac{6(\alpha_2 - \alpha_1)(t - t_o)(1 + m^2)}{h\left[3(1 + m^2) + (1 + mn)(m^2 + \frac{1}{mn})\right]}$$

where:

$$m = \frac{h_1}{h_2}$$

$$n = \frac{E_1}{E_2}$$

This expression may be found in a section authored by Unto U. Savolainen entitled "Theory and Properties of Thermostat Metals" of a book published by John Wiley and Sons, "Engineering Laminates," edited by Albert G. H. Dietz, 1949.

The radii of curvature for strip or plate will be the same provided the Poisson's Ratio is the same for both metals (see Timoshenko article). "L" is the short side of the plate in equation for $\rho_o$.

Figure 9:
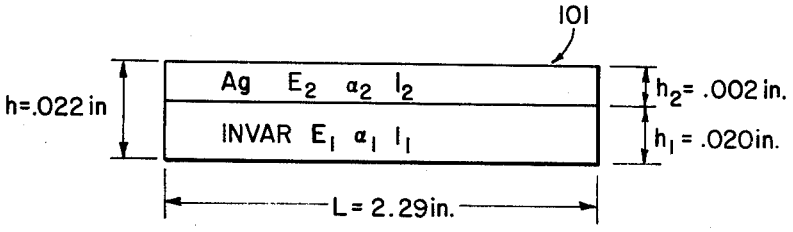
FIG. 9 is a cross sectional representation of a silver-/Invar strip useful in calculating deflections.

Assume a strip as shown in FIG. 9.

| Properties of the Materials | |
|---|---|
| Invar | Silver |
| $\alpha_1$ = .7 PPM/° F | $\alpha_2$ = 10.9 PPM/° F |
| $E_1$ = 21X $10^6$ PSI | $E_2$ = 11X $10^6$ PSI |

From equation (1) choose a = 2

$$\text{then } 3\frac{\delta_o^2}{h^2} = 2 \quad \text{and} \quad \delta_o = .01796 \text{ in.}$$

From equation (2):

$$\delta_1 = \frac{\delta}{\sqrt{\frac{3a}{a-1}}} = .00733 \text{ in.}$$

This deflection is measured from the center line up as shown in FIG. 8 and it is a deflection at which sudden buckling will start if the criteria of equation (3) is met. For $(t - t_o) = 60°$ F calculate $(PL/EI\pi^2)$ from equations (3) and (4)

$$\frac{PL}{EI\pi^2} = 2.281 \qquad \text{Equation (3)}$$

$$\frac{PL}{EI\pi^2} = 1.664 \qquad \text{Equation (4)}$$

Since (3) > (4) or 2.281 > 1.664 a sudden buckling will take place. Calculate $\delta$ from equation (6)

$\delta$ = 0.00936 in. (Downward deflection of a strip with "free" ends)

Then from equation (5) calculate the final deflection down:

$$\delta_2 = \frac{\delta}{1 - \frac{PL^2}{EI\pi^2}} = \frac{.00936}{1 - 2.281} = -.0073 \text{ in. (opposite to } \delta_o)$$

This is the final deflection down from centerline as shown by dashed line 107 in FIG. 8.

Now the final radius of curvature $\rho_2$ can be calculated from:

$$\rho_2 = -\frac{L^2}{8\delta_2} = -89.796 \text{ in. (opposite direction to } \rho_o)$$

The total travel of the thermostat strip is:

$$\delta_o + |\delta_2| = .01796 + .0073 = .02526 \text{ inch.}$$

From the foregoing it should be evident that the invention provides a novel and advantageous microwave resonator having thermal compensation for frequency control through the use of bimetallic boundary motion type phenomena.

It should be understood that the materials used in fabricating the various embodiments of the invention are not critical, and any material or combination of materials exhibiting similar desired characteristics, either metals or nonmetals, may be used.

Although the present invention has been shown and described with reference to particular embodiments, nevertheless various changes, modifications and other embodiments which are obvious to persons skilled in the art to which the invention pertains are deemed to lie within the spirit, scope and contemplation of the invention.

What is claimed is:

1. A thermally compensated frequency controlled microwave resonator for operation over a predetermined operational temperature range, comprising:

a rectangular resonator having conductive inner wall surfaces and oppositely disposed broad and narrow walls, at least one of said broad walls being a composite wall of integral wall layers one of which having a relatively lower thermal expansion coefficient than another of said layers, said composite wall deforming with changes in temperature and having a critical temperature whereat said composite wall snaps from one stabilized curvature condition to a different stabilized curvature condition, said critical temperature being outside said operational temperature range, said composite wall having an initial deformation in one of said stabilized curvature conditions to render said composite wall frequency sensitive.

2. The resonator according to claim 1, also comprising an adjustable tuning screw in at least one of said broad walls.

3. The resonator according to claim 1, wherein both broad walls of said resonator are said composite walls.

4. The resonator according to claim 1, wherein said composite wall is a bimetallic wall.

5. The resonator according to claim 1, wherein the outer one of said layers has a higher thermal expansion coefficient than that of the inner one of said layers.

6. The resonator according to claim 5, wherein said outer layer is relatively thicker than said inner layer.

7. The resonator according to claim 5, wherein said composite wall has an initial inward deformation.

8. The resonator according to claim 6, wherein said outer layer is silver and said inner layer is Invar.

9. The resonator according to claim 1, also comprising a relatively thin layer of a relatively high electrical conductivity material deposited on the inner surface of said resonator walls.

10. The resonator according to claim 9, wherein said thin layer of relatively high electrical conductivity material is silver.

11. The resonator according to claim 9, wherein said thin layer of relatively high electrical conductivity material is copper.

12. The resonator according to claim 9, wherein said thin layer of relatively high electrical conductivity material is copper and silver.

13. A thermally compensated frequency controlled microwave resonator for operation over a predetermined operational temperature range, comprising:

a rectangular resonator having conductive inner wall surfaces and oppositely disposed broad and narrow walls, at least one of said walls being a composite wall of integral wall layers one of which having a relatively lower thermal expansion coefficient than another of said layers, said composite wall deforming with changes in temperature and having a critical temperature whereat said composite wall snaps from one stabilized curvature condition to a different stabilized curvature condition, said critical temperature being outside said operational temperature range, said composite wall having an initial deformation in one of said stabilized curvature conditions to render said composite wall frequency sensitive.

14. The resonator according to claim 13 also comprising an adjustable screw in at least one of said broad walls.

15. The resonator according to claim 13 also comprising a relatively thin layer of relatively high electrical conductivity material deposited on the inner surface of said resonator walls.

16. A thermally compensated frequency controlled microwave resonator for operation over a predetermined operational temperature range, comprising:

a rectangular resonator having conductive inner wall surfaces and oppositely disposed broad and narrow walls, said narrow walls being composite walls of integral wall layers one of which having a relatively lower thermal expansion coefficient than another of said layers, said composite wall deforming with changes in temperature and having a critical temperature whereat said composite wall snaps from one stabilized curvature condition to a different stabilized curvature condition, said critical temperature being outside said operational temperature range, said composite wall having an initial deformation in one of said stabilized curvature conditions to render said composite wall frequency sensitive.

17. The resonator according to claim 16, also comprising at least one adjustable tuning screw in one of said walls.

18. The resonator according to claim 16, also comprising a relatively thin layer of a relatively high electrical conductivity material deposited on the inner surface of said resonator.

19. The resonator according to claim 16, wherein the inner one of said layers has a higher thermal expansion coefficient than that of the outer one of said layers.

20. The resonator according to claim 19, wherein said outer layer is relatively thicker than said inner layer.

21. The resonator according to claim 20, wherein said outer layer is silver and said inner layer is aluminum.

22. The resonator according to claim 21, also comprising a nickel base plate disposed on said aluminum, a copper-silver plating on said aluminum, and said silver layer on said copper-silver plating.

23. The resonator according to claim 22, further comprising a relatively thin silver plated layer on the inner surfaces of said narrow walls.

* * * * *